US005788483A

United States Patent [19]

Drigani et al.

[11] Patent Number: 5,788,483

[45] Date of Patent: Aug. 4, 1998

[54] FURNACE FOR COILS

[75] Inventors: Fausto Drigani, Zugliano; Giacinto Dal Pan, Cellatica, both of Italy

[73] Assignee: Danieli & C. Officine Meccaniche SpA, Buttrio, Italy

[21] Appl. No.: 905,042

[22] Filed: Aug. 1, 1997

[30] Foreign Application Priority Data

Aug. 23, 1996 [IT] Italy ..... UD94 A 0164

[51] Int. Cl.[6] ..... F27B 9/14

[52] U.S. Cl. ..... 432/122; 432/121; 432/246; 198/600

[58] Field of Search ..... 432/121, 122, 432/236, 246; 198/739, 740, 774.3, 600

[56] References Cited

U.S. PATENT DOCUMENTS 4,586,898 5/1986 Orbeck ..... 432/122
5,139,418 8/1992 Rigan et al. ..... 432/122

FOREIGN PATENT DOCUMENTS 9300179 1/1993 WIPO .

*Primary Examiner*—Teresa J. Walberg
*Assistant Examiner*—Jiping Lu
*Attorney, Agent, or Firm*—Stevens, Davis, Miller & Mosher, L.L.P.

[57] ABSTRACT

Furnace for coils installed in a rolling line for wide plate or sheet in an intermediate position between the roughing train and the finishing train, the furnace including at least an inlet (25) and at least an outlet (26) respectively associated with at least a feeding way (12a) and at least a discharge way (12b) for the coils (11), the furnace being defined inside by a plurality of positioning stations (14) defining a substantially central transit channel (15) cooperating at the lower part with means (24) to lift and move the coils (11) step by step between the positioning stations (14), each of which positioning stations (14) comprising support means (118), the support means (118) of at least a desired number of positioning stations (14) located towards the outlet (26) of the furnace (10) including at least a first lowered working position (18a) where the lifting and moving means (24) cooperate with the coils (11) and at least a second raised working position (18b) where the coils (11) are in a position of no contact with the lifting and moving means (24) irrespective of the position which these means (24) assume.

4 Claims, 2 Drawing Sheets

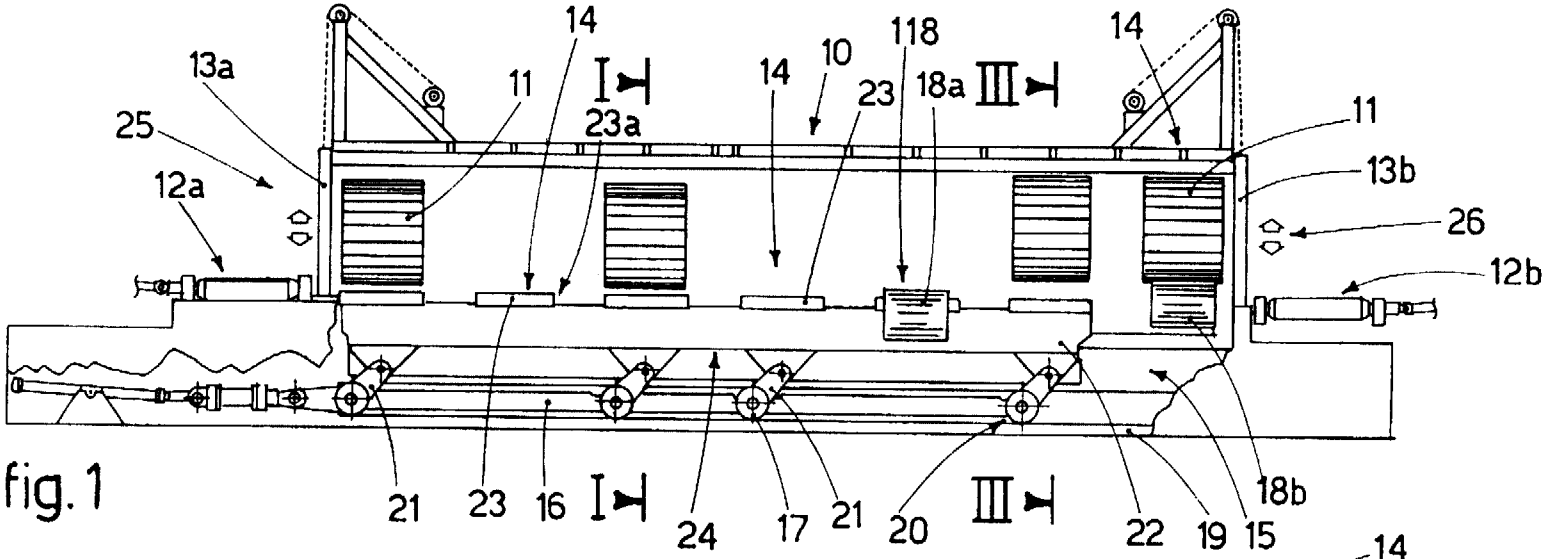
fig.1
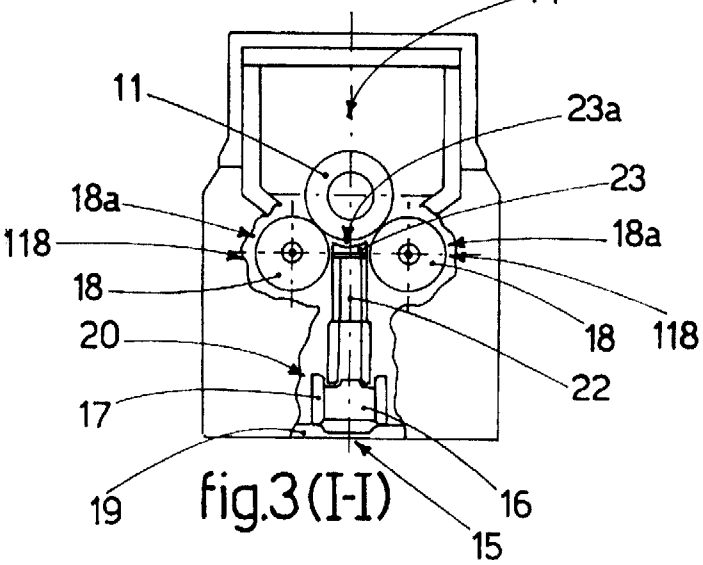
fig.3(I-I)
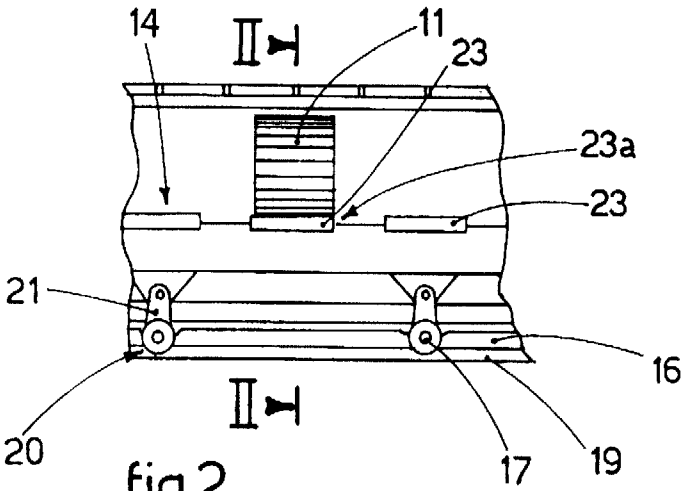
fig.2

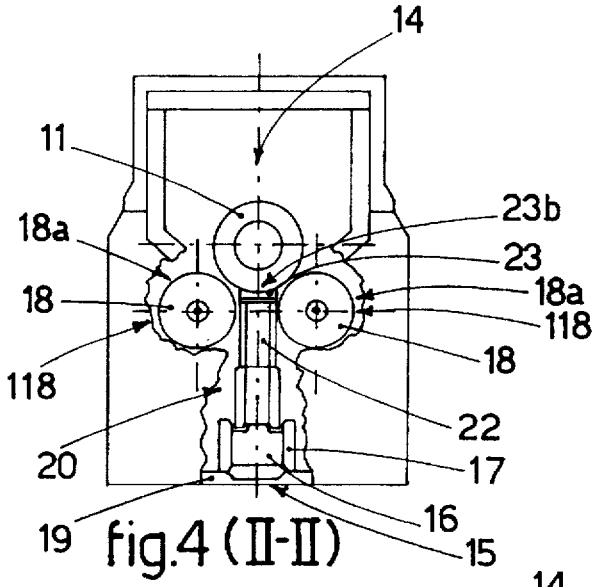
fig.4 (II-II)
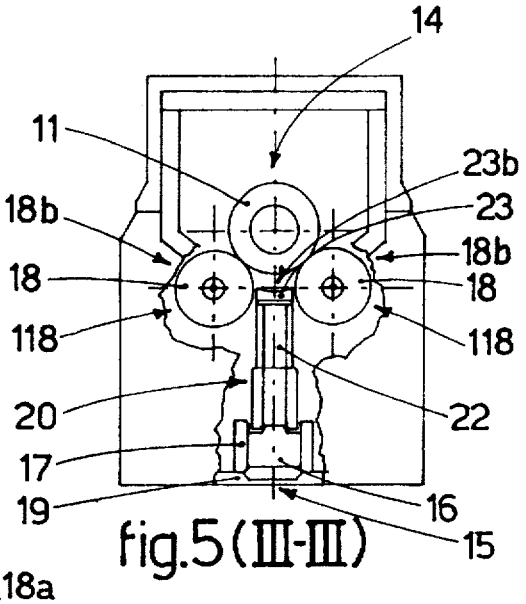
fig.5 (III-III)
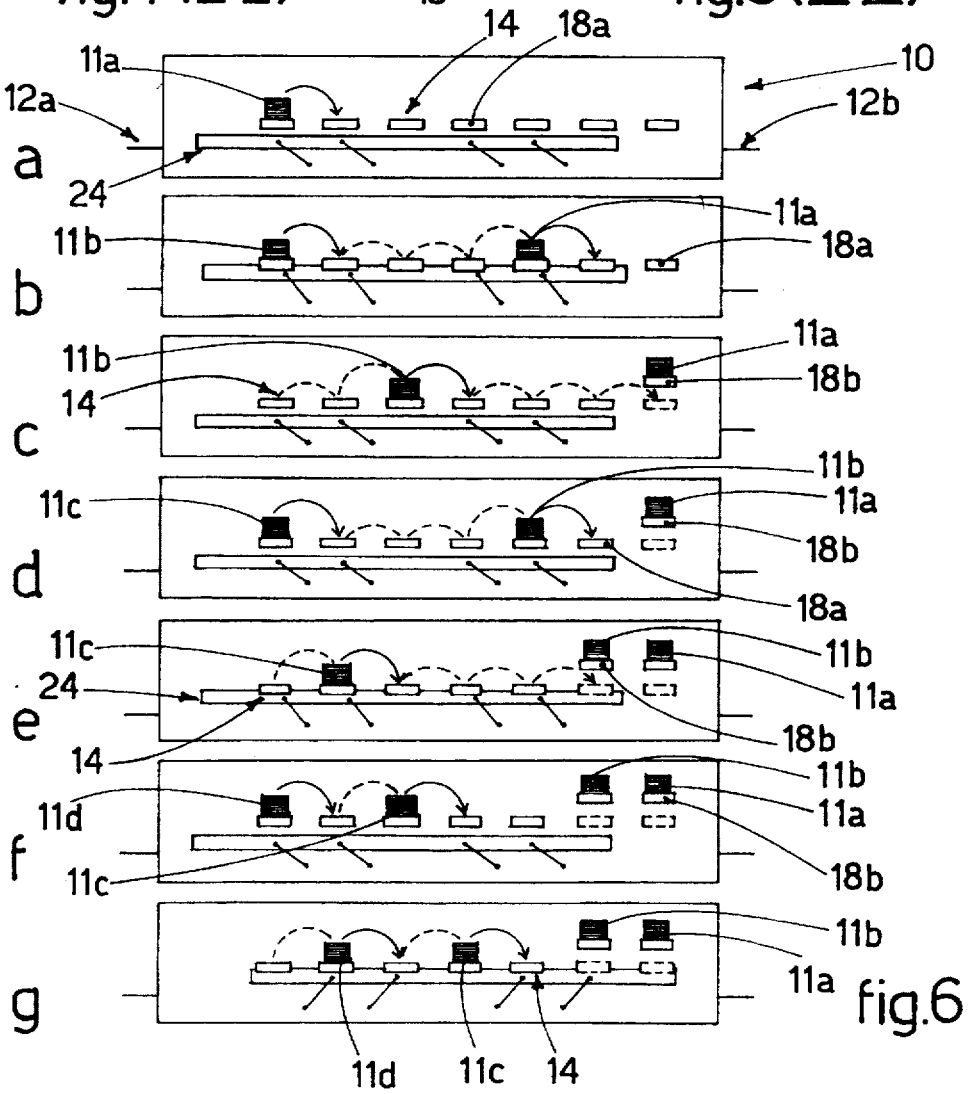
fig.6

FURNACE FOR COILS

FIELD OF THE INVENTION

The invention is applied in rolling lines between the roughing train and the finishing train in order to temporarily store the coils which are to be sent to the finishing process to maintain them and/or bring them to a temperature suitable for rolling on the strip finishing train.

The furnace for coils according to the invention is applied in rolling lines where one or more casting lines are connected directly to the roughing train and feed it in a substantially continuous sequence.

The furnace for coils according to the invention is applied advantageously, but not only, in continuous rolling lines which include the welding of the trailing end of the coil which is already being rolled to the leading end of the following coil which is next to be rolled.

BACKGROUND OF THE INVENTION

The state of the art covers rolling lines which include at least one heating and/or maintenance furnace, located between the roughing train and the finishing train, with the function of restoring and/or maintaining the temperature of the transfer bars wound in coils which have been produced by the roughing train.

These furnaces include a substantially closed, insulated structure, with heating means inside and at least an aperture connected to feeding/discharge ways for the entrance/exit of the coils to be stored/stored.

This structure is associated inside with means to move the coils which cooperate with a plurality of positioning stations located lengthwise in sequence, each of which is suitable to temporarily support a single coil.

For this purpose, each positioning station can include supporting rolls which, apart from supporting the coil, have the function of maintaining it continually in rotation, both in order to ensure uniformity in the surface distribution of the heat, and also to prevent the formation of surface marks or scratches.

In another embodiment, the positioning stations include stationary saddles on which the coils are progressively rested as they are fed into the furnace.

These moving means allow the coils to be moved step by step from one station to the next, lifting them all together from their positioning station and lowering them onto the following positioning station.

The movement of the coils in furnaces for coils known to the state of the art is often unsatisfactory and such as to limit the application and the use of the furnace. In fact, in such furnaces, the step by step movement of one coil from the inlet towards the outlet is only efficient in those cases, which are rare, where the movement of each coil from one station to the next is followed by other coils in such a way as not to leave positioning stations empty.

If this does not happen, then the coils are not immediately available at the outlet, which causes pauses in the working of the finishing train.

In the event that a finishing train is stopped, if a first coil entering the finishing train is translated to the outlet without waiting for other coils to occupy the previous stations, then in order to make this coil immediately available for rolling as soon as the finishing train is re-activated, it is not possible to introduce and move forward a second coil until the first coil has been discharged from the furnace.

In other words, in furnaces for coils known to the state of the art, when a coil is near the outlet, it is immediately available for rolling as soon as the finishing train is re-activated, but it is not possible to introduce and feed any other coils.

Therefore, with such furnaces as are known to the state of the art, it is necessary to respect a step by step movement of the coils, without there being empty positioning stations between the coils introduced, and this causes, especially when there is a large number of stations and short pauses in the finishing train, a lengthening of the discharge times from the furnace and a discontinuity in the working of the finishing train.

This movement is therefore only suitable for a limited heating of the coil but it is absolutely not possible to use it to create a "buffer store" between the roughing train and the finishing train, particularly in those cases where the finishing train becomes blocked while the roughing train connected to the continuous casting continues to produce, given the need to prevent the casting itself from becoming blocked.

A solution has been proposed in order to obtain this function as a buffer store, where the movement inside the furnace is achieved by means of a trolley including means to lift and translate the coils, but this solution also involves a series of disadvantages.

In this case, at least the upper part of the trolley must be housed, and must move, inside the furnace, inside which there are extremely high temperatures, and also the furnace must have in its lower part a slot which will allow the means to lift and translate the coil, which are present on the trolley, to enter, lift the coil, translate it, place it in the next station and then leave the furnace.

It is therefore necessary to provide a system to close the slot, in order to prevent the lower area of the furnace from over-heating and thus create difficulties for the trolley.

This system is therefore complex, it is difficult to achieve the closure of the slot, the trolley is subject to rapid wear, there are high levels of heat loss, and in general movement is extremely difficult.

SUMMARY OF THE INVENTION

The present applicants have designed, tested and embodied this invention to overcome the shortcomings of the state of the art and to achieve further advantages.

The purpose of the invention is to provide a furnace for coils, installed in a rolling line, suitable to make the coils immediately available as they leave the furnace, irrespective of the presence/absence of other coils entering the furnace and/or without the different stations of the furnace needing to be completely occupied by coils.

A further purpose of the invention is to obtain a furnace which, installed between the roughing train and the finishing train in a rolling line, can function as a buffer store in the event that there is a temporary blockage in the finishing train, thus allowing the continuous casting to continue producing without slowdowns or stoppages in the line.

A further purpose of the invention is to obtain a system which ensures great reliability, long duration, little maintenance, reduced or zero heat losses and yet other advantages.

The furnace for coils according to the invention includes a containing structure substantially of the type known to the state of the art, insulated, having heating means and cooperating with at least a feeder way/discharge way for the coils, associated with the rolling line by means of at least one feeder way/discharge way for the said coils.

Inside this containing structure there is defined a plurality of positioning stations at intervals, each of which has means to temporarily support the individual coil.

These support means, in one embodiment of the invention, are composed of rotary supporting rolls.

In a variant of the invention, the support means are composed of stationary supporting saddles.

The positioning stations are associated at the lower part with means to lift and move the coils step by step, known as walking beams, which make it possible to displace the coils from one station to another.

These lifting and moving means are capable of an alternate movement which allows them to lift in a single action all the coils inside the furnace, lower them onto the following station and then re-position them in the starting position.

According to the invention, the support means, whether they be supporting rolls or supporting saddles, have at least two working positions, respectively the first lowered position and the second raised position.

In the first lowered position it is possible to maintain the coil at a height where the lifting and moving means are able to cooperate with the coils, lift them and displace them to the following positioning station.

The second raised position takes the coils to a position of no-contact with the lifting and moving means in such a way that the coils which have been raised are not moved even when the lifting and moving means are activated.

According to the invention therefore, it is possible to move each coil in a substantially independent way from the other coils contained in the furnace.

It is possible, for example, to take a coil from the inlet of the furnace immediately to a station located near the outlet of the furnace, and keep it in this station by moving the support means into the second, raised position where the coil is not in contact with the lifting and moving means.

In this way it is possible to make a large number of coils available at the outlet of the furnace without waiting for all the positioning stations of the furnace to be filled in sequence.

In other words, according to the invention it is possible to fill the furnace starting from the last station, which is located near the outlet, gradually filling the other stations towards the inlet one after the other.

The furnace can therefore be used as a buffer store in a rolling line connected to a continuous casting machine where the stoppages of the finishing train are absorbed by the furnace, which can be filled with all the coils as they are produced, without the continuous casting having to be stopped upstream.

Moreover, when the finishing train is re-activated, the coils are all stored in sequence towards the outlet, which reduces the downtimes of the cycle.

According to a first embodiment of the invention, all the support means of the furnace are able to assume, independently of each other, the above-mentioned first lowered and second raised working positions.

According to a variant, only a desired number of positioning stations, located near the outlet of the furnace, have support means which are able to assume the said first lowered and second raised working positions.

BRIEF DESCRIPTION OF THE DRAWINGS

The attached figures are given as a non-restrictive example and show a preferred embodiment of the invention as follows:

FIG. 1 shows a longitudinal view, partly in section, of a furnace for coils according to the invention in its operating position;

FIG. 2 shows a partial view of the furnace of FIG. 1 in another operating position FIG. 3 shows a section along the line I—I of FIG. 1;

FIG. 4 shows a section along the line II—II of FIG. 2;

FIG. 5 shows a section along the line III—III of FIG. 1;

FIGS. 6*a*–6*g* shows in diagram form a possible working cycle of the furnace of FIG. 1.

DETAILED DESCRIPTION OF THE PREFERRED EMBODIMENTS

The furnace 10 for coils 11 according to the invention is used, in a rolling line which is not shown here, between the roughing train and the finishing train, to heat and/or maintain the temperature of the coils 11 leaving the roughing train before the coils 11 are sent to the finishing train.

The furnace 10 is used also to store the coils 11 temporally, keeping them at the appropriate temperature, in the event of stoppages in the downstream finishing train due to maintenance, replacement of the rollers, blockages etc.

The furnace 10 has an inlet 25 with shutter means 13*a* which can be temporally activated, and an outlet 26 with shutter means 13*b* which can be temporally activated which associate the furnace respectively with a roller way 12*a* to feed the coils 11 and a roller way 12*b* to discharge the coils 11.

In the example shown, the furnace 10 according to the invention has seven positioning stations 14, arranged in a series along the length of the furnace 10 so as to define a transit channel 15 with which the lifting and moving means 24 to lift and move the coils 11 cooperate.

Each of these positioning stations 14 is suitable to support a single coil 11 and has an opposed pair of support means 118, in this case of the roll type 18, which also have the function of maintaining the coils 11 in continual rotation.

The following description concerns the use of supporting rolls 18, but the invention is also applied in the case where the support means 118 are stationary saddles.

In order to simplify the illustration, FIG. 1, where the first positioning station 14 is the one next to the inlet 25, shows only the supporting rolls 18 relating to the last positioning station 14 and the fifth positioning station 14.

The coila 11 are fed to and discharged from the furnace 10 by means of the lifting and moving means 24, which also transfer the coils 11 from one positioning station 14 to the other.

In the example shown, these lifting and moving means 24, or walking beams, are composed of a movable beam 16, which is able to move axially with an alternated movement along the transit channel 15 of the furnace 10, by means of wheels 17 which cooperate with the resting plane 19.

The movable beam 16 has means 20 to lift/lower the coils 11, in this case composed of oscillating arms 21 associated with a blade element 22 with, on the upper part, saddle elements 23.

As a result of the rotary movement of these oscillating arms 21, the saddle elements 23 assume two extreme positions, respectively a first resting position 23*a* (FIGS. 2 and 3) and a second operating position 23*b* (FIGS. 4 and 5).

In the first resting position 23*a*, the saddle elements 23 are inactive as they are not in contact with the coils 11.

In the second, operative position 23*b*, the saddle elements 23 lift the coils 11 from the rollerway 12*a* to feed the coils 11 and/or from the pair of rolls 18 of the relative positioning station 14. Once the coils 11 have been lifted, they are translated by means of the movable beam 16 in correspondence with the following positioning station 14, or if necessary onto the rollerway 12*b* to discharge the coils 11, and lowered until they again rest on the relative rolls 18.

According to the invention, the supporting rolls 18 of at least some of the positioning stations 14 of the furnace 10 can have at least two working positions, respectively a first, lowered position 18*a* and a second, raised position 18*b*.

The first, lowered position 18*a* (FIGS. 1–4) allows the saddle elements 23, when they are in their working position 23*b*, to lift the coil 11 and to move it from one positioning station 14 to another.

The second, raised position 18*b* (FIG. 5) takes the coil 11 to a higher level than that reached by the saddle elements 23 in their operating position 23*b* and therefore the coil 11 does not come into contact with the lifting and moving means 24.

In this way it is possible to accumulate the coils 11 progressively towards the outlet 26, therefore making them immediately available for rolling, and allowing new coils 11 to be introduced into the furnace 10 even when there is a coil 11 near the outlet 26.

With this invention therefore it is possible to exploit the furnace 10 more rationally and also to eliminate any downtimes in the production cycle and any intervals in the functioning of the finishing train.

Moreover, the embodiment according to the invention makes it possible to reduce to a minimum, according to the times of the cycle, the number of coils 11 normally present inside the furnace 10, and therefore increase the capacity of the furnace 10 as a buffer store.

In FIGS. 6*a*–6*g* there is the illustration of a possible cycle to store the coils 11 inside the furnace 10 according to the invention during a temporary stoppage of the finishing train.

In FIG. 6*a*, the coil 11*a* has just been removed from the rollerway 12*a* to feed the coils 11 and placed onto the first positioning station 14 by means of the lifting and moving means 24.

This first positioning station 14 and also all the remaining positioning stations 14 of the furnace 10 have their rollers 18 in a lowered position 18*a* and therefore the lifting and moving means 24 can progressively transfer the coil 11 towards the outlet 26 step by step.

As the coil 11*a* is fed forwards, a new coil 11*b* (FIG. 6*b*) is fed from the rollerway 12*a* and this new coil 11*b* is moved towards the outlet 26 of the furnace 10 at the same time as the coil 11*a*.

When the coil 11*a* has reached the last positioning station 14 (FIG. 6*c*), that is, the one near the outlet 26, the rolls 18 of this last positioning station 14 are taken to the raised position 18*b* and thus allow the coil 11*a* to remain inside the furnace 10 and, at the same time, allow the coil 11*b* and a new coil 11*c* (FIG. 6*d*) to continue their forward movement towards the outlet 26 of the furnace 10.

In FIG. 6*e* the coil 11*b* has just reached the sixth positioning station 14, whose rolls 18 have therefore been taken to the raised position 18*b* in order to allow the coil 11*b* to remain in the said sixth positioning station 14.

In this way the lifting and moving means 24 are able to continue to move the coil 11*c* and the new coil lid (FIGS. 6*f*, 6*g*) towards the outlet 26 of the furnace 10 without coming into contact with the coils 11*a* and 11*b*.

When these coils 11*c* and 11*d* reach respectively the fourth and fifth positioning station 14, they too are lifted by the rollers 18 which are already in the raised position 18*b*, thus allowing the furnace to be completely filled with the following coils 11 which are being produced.

As soon as the finishing train located downstream of the furnace 10 is re-activated, the rolls 18 are taken back to the lowered position 18*a* and thus it is possible to discharge the coil 11*a* onto the rollerway 12*b* to discharge the coils 11, and also it is possible for the other coils 11*b, c, d* to move towards the outlet 26.

At this point, if new coils 11 are fed to the furnace 10, the rolls 18 of the last three positioning stations 14 occupied by the coils 11*b, c, d* are again taken to their raised position 18*b* and thus the lifting and moving means 24 are able to translate the new coils 11 while the coils 11*b, c, d* are maintained inside the furnace 10.

We claim:

1. A furnace for coils installed in a rolling line for wide plate or sheet in an intermediate position between a roughing train and a finishing train, the furnace having at least one inlet (25) and at least one outlet (26) respectively associated with a way (12*a*) to feed the coils (11) and a way (12*b*) to discharge the coils (11), the furnace being defined inside by a plurality of positioning stations (14) defining a substantially central transit channel (15) cooperating at the lower part with means (24) to lift and move the coils (11) step by step between the positioning stations (14), each of the positioning stations (14) comprising support means (118), the furnace being characterised in that the support means (118) of at least a desired number of positioning stations (14) located towards the outlet (26) of the furnace (10) include at least a first, lowered working position (18*a*) where the lifting and moving means (24) cooperate with the coils (11), and a second, raised working position (18*b*) where the coils (11) are in a position of no-contact with the lifting and moving means (24) irrespective of the position assumed by said means (24).

2. The furnace for coils as in claim 1, wherein the support means (118) are composed of opposed supporting rolls (18) rotating in a coordinated manner.

3. The furnace for coils as in claim 1, wherein the support means (118) are composed of stationary supporting saddles.

4. The furnace of claim 1, wherein said ways are roller ways.

* * * * *